US006450308B1

(12) United States Patent
Kuo

(10) Patent No.: US 6,450,308 B1
(45) Date of Patent: Sep. 17, 2002

(54) SAFETY MECHANISM FOR BEZEL OF LUGGAGE WITH RETRACTABLE HANDLE

(75) Inventor: Chung-Hsien Kuo, Pan-Chiao (TW)

(73) Assignee: Chaw Khong Technology Co., Ltd., Taipei (TW)

( * ) Notice: Subject to any disclaimer, the term of this patent is extended or adjusted under 35 U.S.C. 154(b) by 0 days.

(21) Appl. No.: 09/906,729

(22) Filed: Jul. 18, 2001

(30) Foreign Application Priority Data

Sep. 16, 2000 (TW) ..... 89216041 U

(51) Int. Cl.[7] ..... A95C 13/26
(52) U.S. Cl. ..... 190/115; 16/113.1
(58) Field of Search ..... 190/115; 16/113.1

(56) References Cited

U.S. PATENT DOCUMENTS 6,148,478 A * 11/2000 Kuwayama ..... 190/115
6,338,400 B1 * 1/2002 Wu ..... 190/39

FOREIGN PATENT DOCUMENTS

CN 387218 4/2000

* cited by examiner

*Primary Examiner*—Lee Young
*Assistant Examiner*—Tri M. Mai
(74) *Attorney, Agent, or Firm*—Troxell Law Office PLLC

(57) ABSTRACT

A safety mechanism for bezel of luggage with retractable handle is disclosed. Safety device is implemented as a vertically movable F-shaped mechanism in the bezel. F-shaped mechanism is moved down into bezel as handle grip is pressed down until handle grip is locked by a locking device. Further, F-shaped mechanism is automatically returned to a predetermined position when the hand of user is off the F-shaped mechanism. The locking device of handle is deactivated when F-shaped mechanism is pressed down to a predetermined position while retracting the handle. And in turn, handle is automatically bounced up a predetermined sufficient height for facilitating user to pull the handle thereafter. Most importantly, user is prevented from being hurt while retracting the handle.

7 Claims, 7 Drawing Sheets

SAFETY MECHANISM FOR BEZEL OF LUGGAGE WITH RETRACTABLE HANDLE

BACKGROUND OF THE INVENTION

1. Field of the Invention

The present invention relates to luggage and more particularly to a safety mechanism for bezel of luggage with retractable handle for preventing user from being hurt while retracting the handle.

2. Description of Related Art

Wheeled luggage have become more popular among travelers. Conventionally, such wheeled luggage is equipped with a retractable handle which is anchored at a bezel located at the edge on the top of luggage as shown in FIG. 1. Handle T is supported in bezel B. bezel B comprises a concave member B1 for receiving handle grip H. Concave member B1 consists of a top plate U, a vertical plate V, and a seat plate L. When user wants to retract handle grip H onto concave member B1 in a storage or non use condition, simply presses handle grip H and handle T down with fingers for receiving handle grip H onto concave member B1. As shown, the back of the fingers (thumb not included) tends to rub with the sharp corner C at the intersection of top plate U and vertical plate V. In a worse condition, the hand of user may be hurt if enough care is not taken.

Taiwanese Patent Published No. 387,218 entitled "Collision Free Arrangement for Retractable Handle of Luggage" disclosed a pad on the back of bezel for providing a cushion while retracting the handle. But such pad is an independent device for only having a single functionality. As such, no further improvement on the operation of luggage has been suggested therein.

SUMMARY OF THE INVENTION

It is thus an object of the present invention to provide a safety mechanism for bezel of luggage with retractable handle. Safety device is moved down into bezel as handle grip is pressed down until handle grip is locked by locking device of bezel. Further, safety device is automatically returned to a predetermined position when hand is off the safety device. Locking device of handle is deactivated when safety device is pressed down to a predetermined position while retracting the handle. And in turn, handle is automatically bounced up a predetermined sufficient height for facilitating user to pull the handle thereafter.

To achieve the above and other objects, the present invention provides a safety mechanism of luggage with a retractable handle assembly including a handle grip, a pair of sliding tubes having an upper hole, and a bezel having a concave member having a tunnel on either side for permitting each sliding tube to slide therein, a vertical plate, a seat plate, and a top plate, the safety mechanism comprising: an elongate transverse groove between the vertical plate and the top plate; an elongate recessed engagement mechanism abutted on the sides, the bottom, and the rear of the transverse groove, the engagement mechanism including a bottom portion, a vertical portion, two spaced posts on the bottom portion, two first spring put on the posts a guide in the front of the posts, and an elongate vertical recess at either side of the vertical portion of the engagement mechanism wherein in a fully retracted position of the handle, the first springs are urged against and to push the F-shaped mechanism upward to engage with the underside of top plate of the bezel; a locking device at either side of the engagement mechanism including a socket at either side of the bottom portion of the engagement mechanism, the socket including a bottom opening, a top opening, and a front opening; an F-shaped mechanism being vertically movable in the engagement mechanism the F-shaped mechanism including an upper horizontal portion, a vertical portion, an extension on either side, a flange on the top of the extension, a central divider below the horizontal portion, a recessed portion at either side of the central divider such that the posts are capable of passing through recessed portions when the F-shaped mechanism is moving vertically, and the bottom of the vertical portion of the F-shaped mechanism is capable of moving into the guide through the transverse groove; two spaced tube members with notched circumferential surface at the underside of the top plate of the bezel; two spaced slots at the vertical portion of the engagement mechanism such that the engagement mechanism is capable of being secured to the top plate of the bezel by driving fasteners through the tube members and the spaced slots; a flexible latched member in either underside of the seat plate of the bezel being clung to the bottom opening of the socket such that the F-shaped mechanism is capable of moving vertically with the flanges on the top of the extension being slidably received in the recesses; a wedge at the underside of either extension of the F-shaped mechanism, the wedge including a front planar portion and a rear slanted surface; a locking block in the socket, the locking block including a recessed slanted surface, a spring loaded rear peg, and a front stud; and a bouncing device at the lower part of each sliding tube, the bouncing device including an upper frame member, a lower abutment member held by the upper frame member, a sliding block having a catch within the lower abutment member, and a second spring anchored in the lower abutment member; whereby pull the handle grip to activate the bouncing device to push each sliding tube upward to cause the handle grip to bounce a predetermined distance above the top plate of the bezel; and press down the handle grip to cause the F-shaped mechanism to move down simultaneously thus forming a space in the bezel by the downward moved the F-shaped mechanism.

The above and other objects, features and advantages of the present invention will become apparent from the following detailed description taken with the accompanying drawings.

DETAILED DESCRIPTION OF THE PREFERRED EMBODIMENTS

Figure 1:
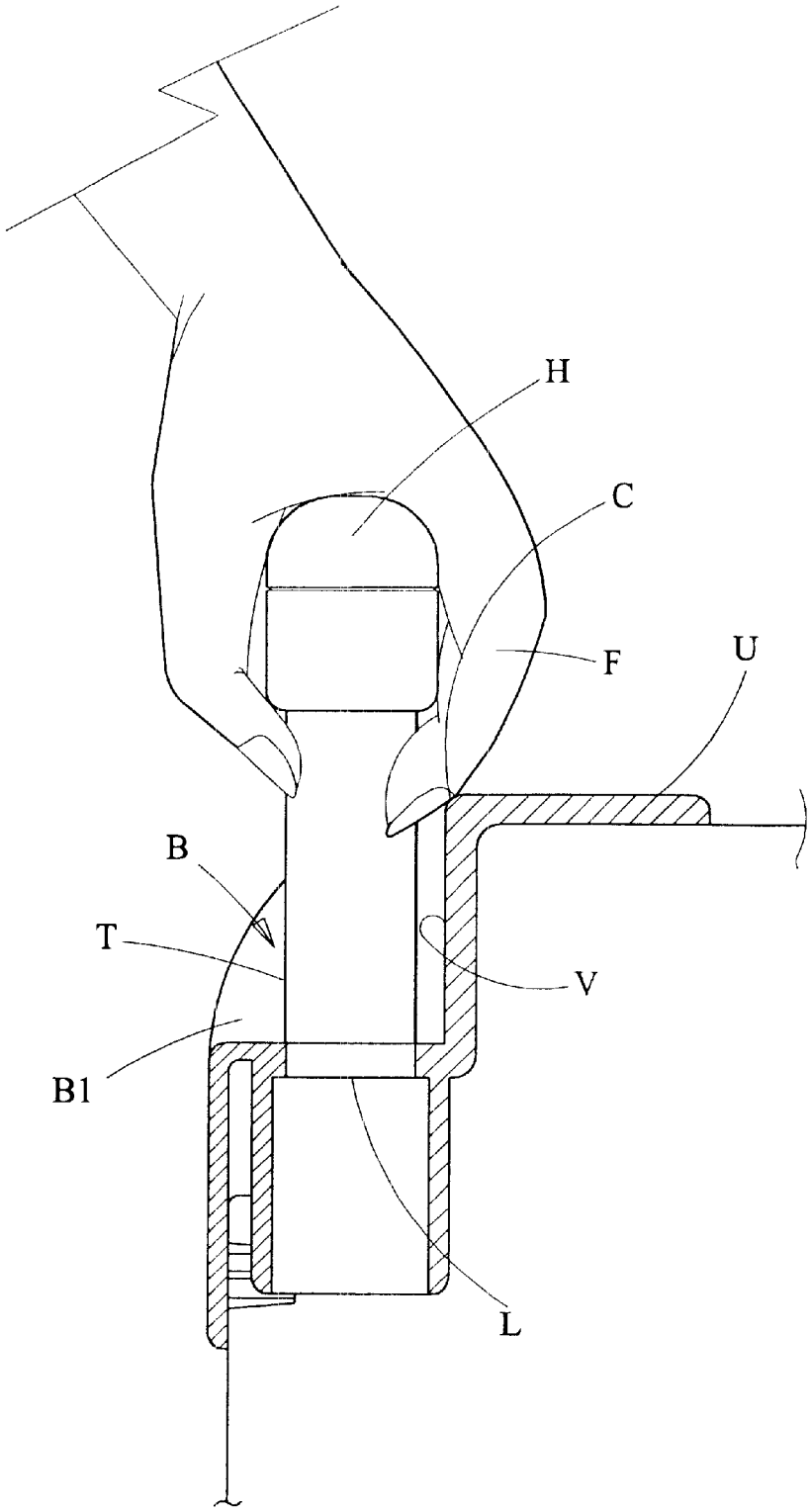
FIG. 1(PRIOR ART)
FIG. 1 is a cross-sectional view of bezel of a conventional luggage with retractable handle.

Referring to FIGS. 2 to 6B, a safety mechanism is mounted on a bezel 10 of luggage. The configuration of the safety mechanism is detailed below. A handle 21 having a handle grip 20 is anchored at bezel 10. A bouncing device 30 is provided at the lower part of handle 21. Bezel 10 comprises a concave member 11 including a tunnel 12 on either side for permitting sliding tube of handle 21 to slide therein, a vertical plate 13, a seat plate 14, and top plate 15. An elongate transverse groove 16A is provided between vertical plate 13 and top plate 15. An elongate recessed engagement mechanism 16 is provided abutted on the sides, the bottom, and the rear of groove 16A. An F-shaped mechanism 17 is provided being vertically movable in the engagement mechanism 16. A locking device 167 is at both sides of engagement mechanism 16 for controlling the activation of bouncing device 30. Engagement mechanism 16 comprises a bottom portion 161 and a vertical portion 162. Two spaced posts 163 are provided on bottom portion 161. A spring 164 is put on post 163. A guide 166 is provided in the front of posts 163. An elongate vertical recess 165 is provided at side wall 162A of vertical portion 162.

F-shaped mechanism 17 comprises an upper horizontal portion 171, a vertical portion 172, and an extension 176 extending outwards from two sides of the F-shaped mechanism 17. Upper horizontal portion 171 and vertical portion 172 are formed of soft material, while extension 176 is formed of hard material. Also, the extension 176 of the F-shaped mechanism may be formed integrally with the F-shaped mechanism 17. A central divider 174 is formed below horizontal portion 171. A recessed portion 175 is formed at either side of central divider 174 such that posts 163 may pass through when F-shaped mechanism 17 is moving vertically. Generally speaking, the width of upper horizontal portion 171 is about the same as that of groove 16A and bottom portion 161 of engagement mechanism 16, while the length of vertical portion 172 is slightly larger than the height of vertical portion 162. As such, the bottom of vertical portion 172 of F-shaped mechanism 17 may move into guide 166 through gap 166A in groove 16A. Two spaced tube members 151 with notched circumferential surface are formed at the underside of top plate 15 of bezel 10. Two spaced slots 1622 are formed at vertical portion 162 of engagement mechanism 16. As such, engagement mechanism 16 may be secured to top plate 15 of bezel 10 by driving screws 152 through tube members 151. Flexible latched member 142 at projection 141 in either underside of seat plate 14 of bezel 10 is clung to opening 1673 at the bottom of socket 1671 at either side of bottom portion 161. As such, F-shaped mechanism 17 may move vertically with flanges 177 on the top of extension 176 being slidably received in recesses 165. In a fully retracted position of handle 21 as shown in FIGS. 5A and 5B, springs 164 are urged against F-shaped mechanism 17 to push F-shaped mechanism 17 upward to cause flanges 177 to engage with the underside of top plate 15 of bezel 10. As a result, the top of horizontal portion 171 of F-shaped mechanism 17 is flush with the top plate 15 of bezel 10. It is designed that F-shaped mechanism 17 is moved down as user presses down handle grip 20. As such, the fingers of the user are prevented from being hurt while retracting the handle 21 because horizontal portion 171 of F-shaped mechanism 17 is moved down immediately after fingers touch it. The operation of pressing down F-shaped mechanism 17 by hand is best illustrated in FIG. 4A.

A wedge 178 is provided at the underside of either extension 176 of F-shaped mechanism 17 for activating the locking mechanism. Wedge 178 comprises a front planar portion 1781 and a rear slanted surface 1782. Locking device 167 comprises a socket 1671 having a top opening 1672 for permitting the slanted surface 1782 of wedge 178 to insert through. The front of socket 1671 is an opening 1674. A spring 1675 and a locking block 1677 are disposed in socket 1671. Locking block 1677 comprises a recessed slanted surface 1678, a rear peg 1675A with spring 1675 put on, and a front stud 1679.

Figure 4A:
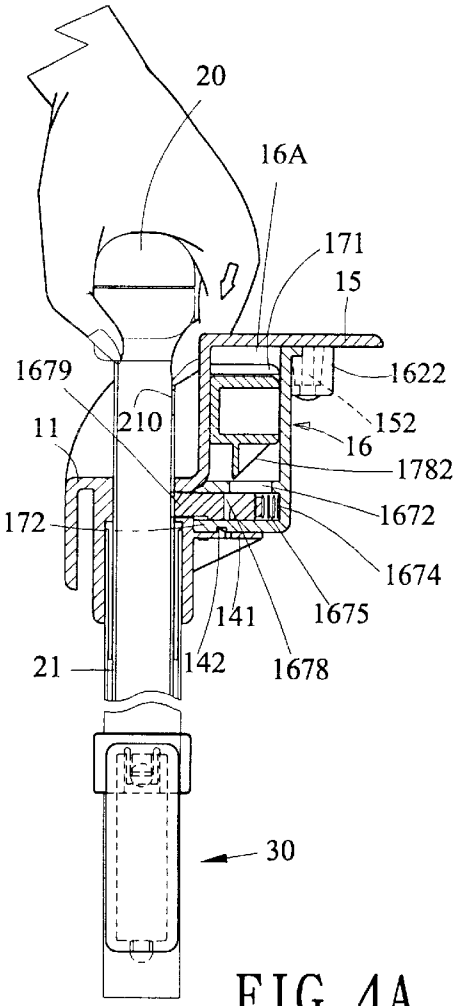
FIG. 4A is a cross-sectional view of the safety device showing the operation of a partially retracted handle.
Figure 4B:
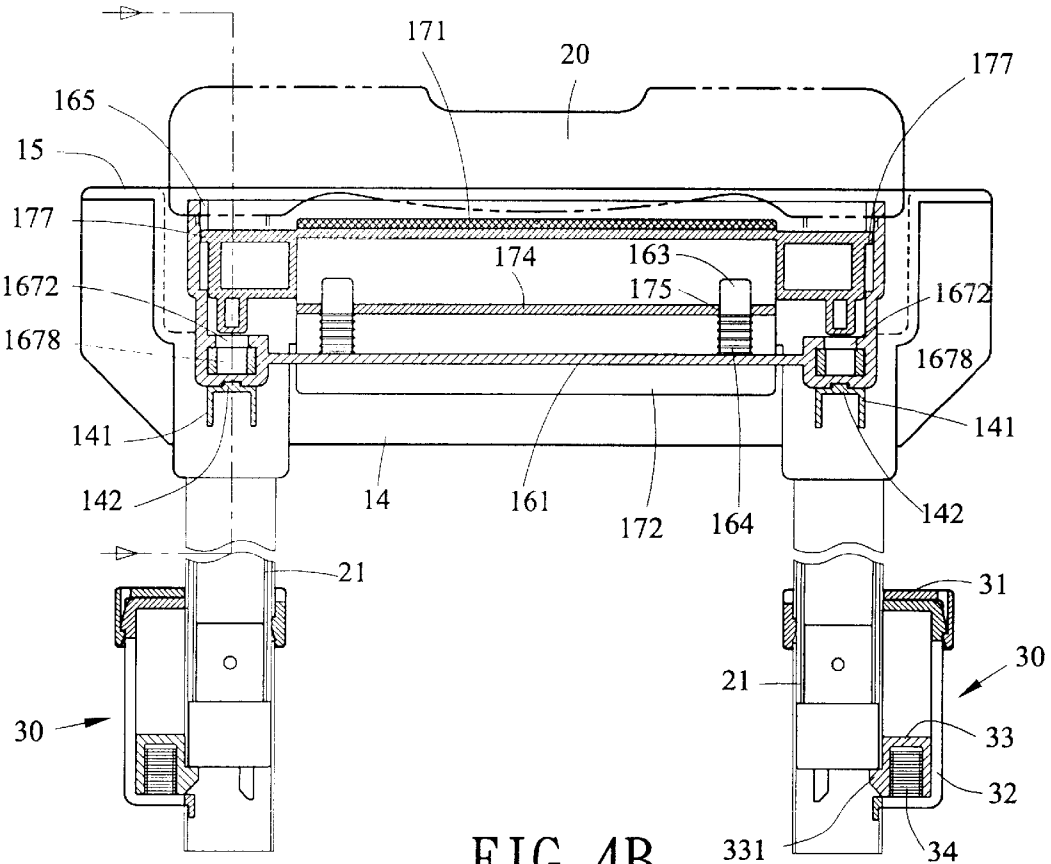
FIG. 4B is another cross-sectional view of the safety device showing the operation of the partially retracted handle shown in FIG. 4A.
Figure 5A:
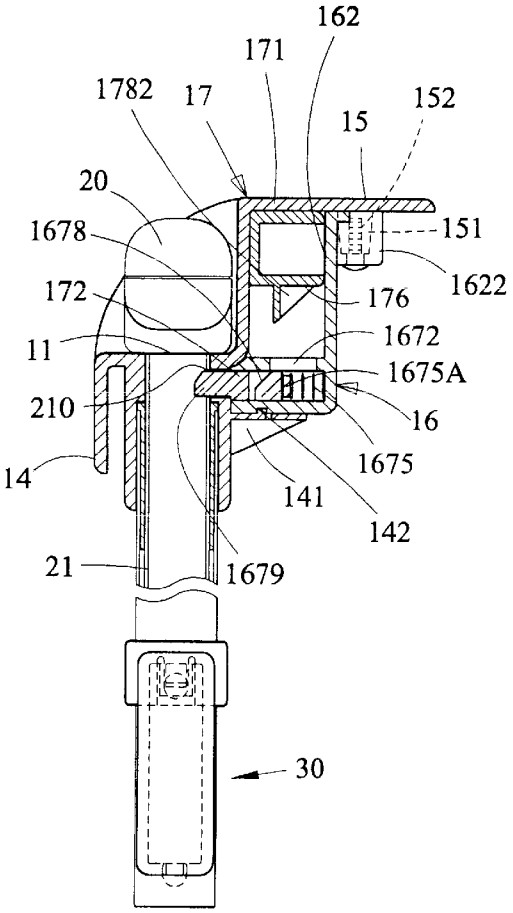
FIG. 5A is a cross-sectional view of the safety device showing the operation of a fully retracted handle.
Figure 5B:
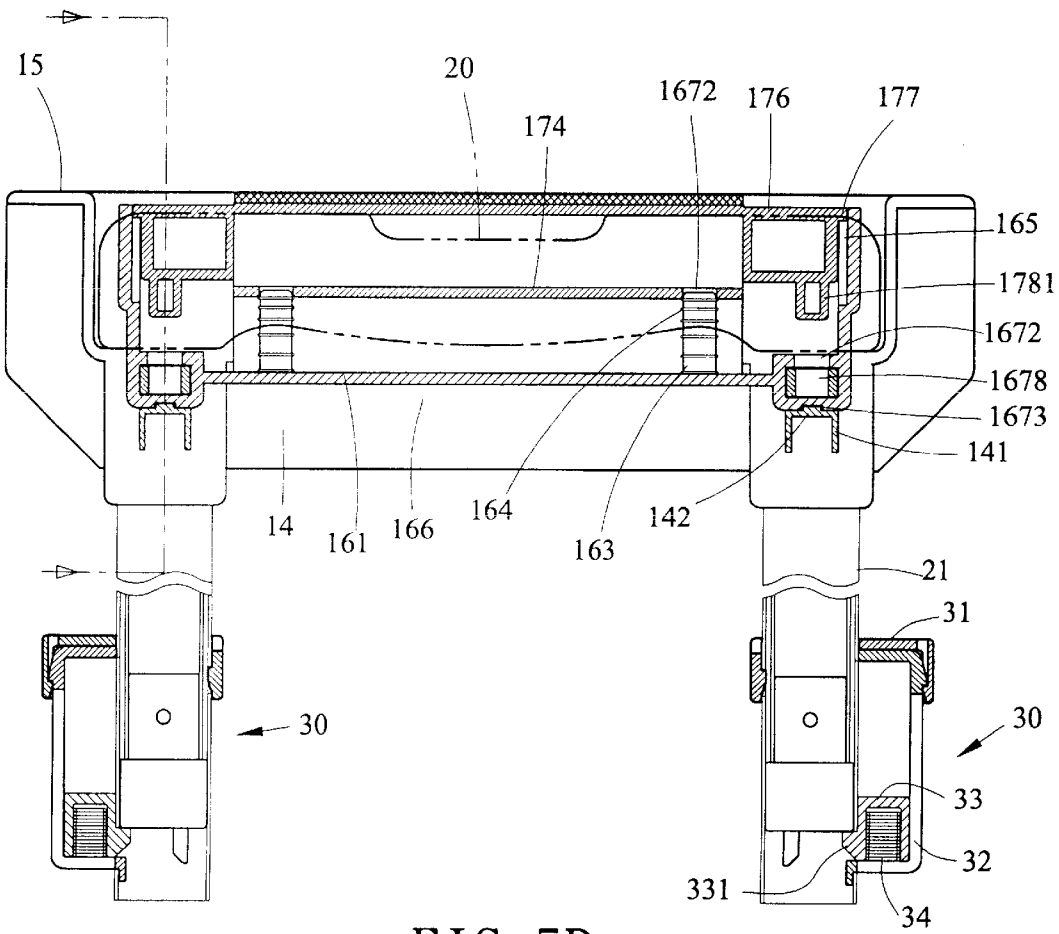
FIG. 5B is another cross-sectional view of the safety device showing the operation of the fully retracted handle shown in FIG. 5A.

As shown in FIGS. 4A and 4B, the safety device not only has the functionality of preventing user from being hurt while retracting the handle 21, but also the F-shaped mechanism 17 supported by springs 164 has the functionality of unlocking the handle 21. In detail, slanted surface 1782 of wedge 178 is disengaged from the top opening 1672 (i.e., above socket 1671) in an unlocked position. In this position, flanges 177 of F-shaped mechanism 17 are free to slide along recesses 165. It is seen that the bottom of wedge 178 is above the recessed slanted surface 1678 of locking block 1677 by a predetermined safe distance. Thus, locking device 167 is free from error during the retracting operation.

Bouncing device 30 is a further safety mechanism of the invention. Bouncing device 30 comprises an upper frame member 31, a lower abutment member 32 held by upper frame member 31, a sliding block 33 having a catch 331 within the lower abutment member 32, and a spring 34 anchored in the lower abutment member 32.

Figure 5C:
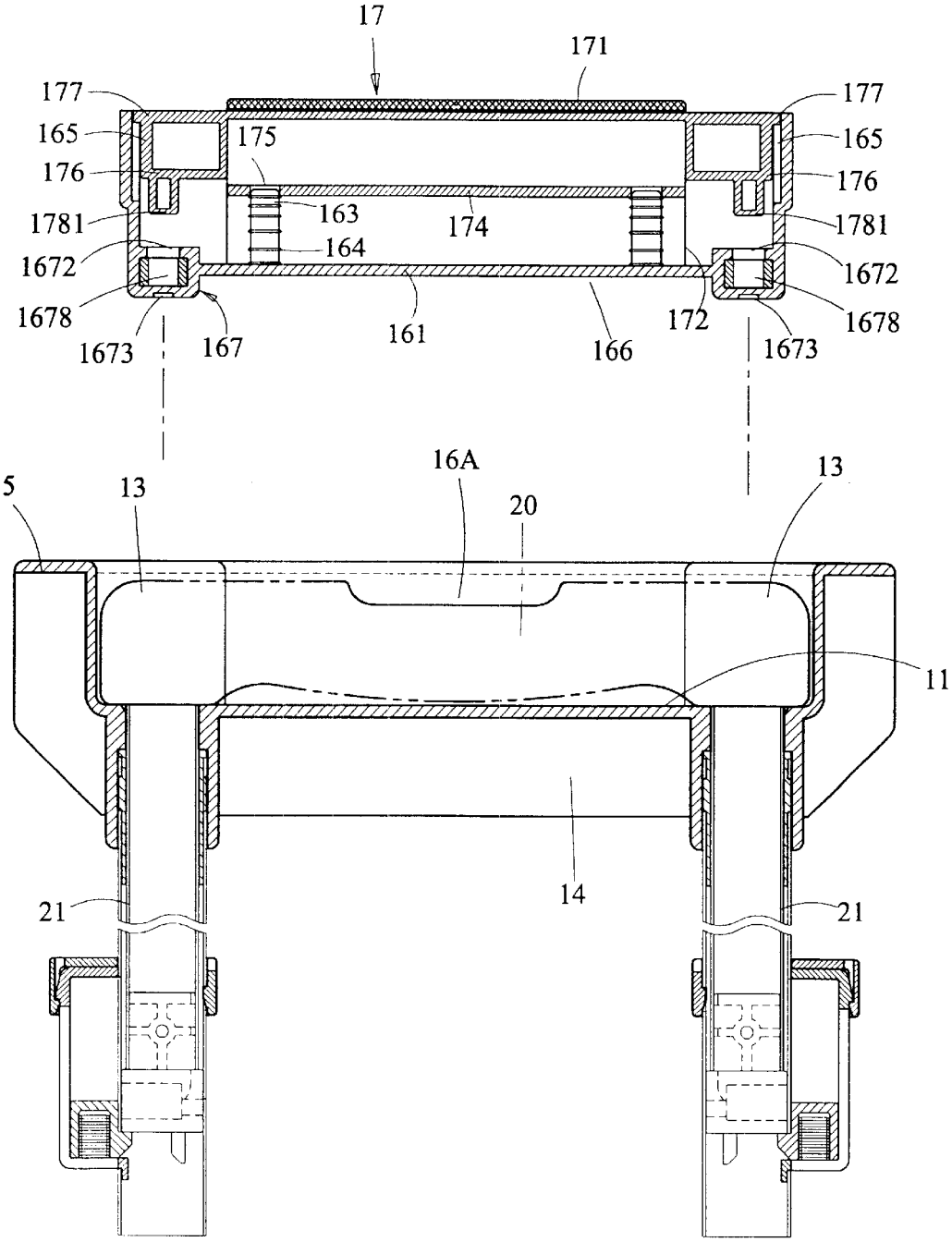
FIG. 5C is an exploded view of FIG. 5A device.
Figure 6A:
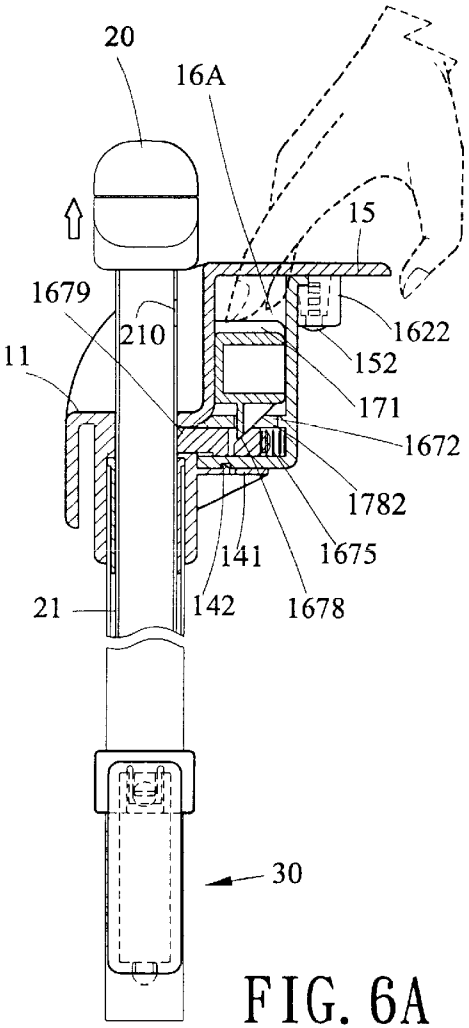
FIG. 6A is a cross-sectional view of the safety device showing the operation of a partially pulled handle.
Figure 6B:
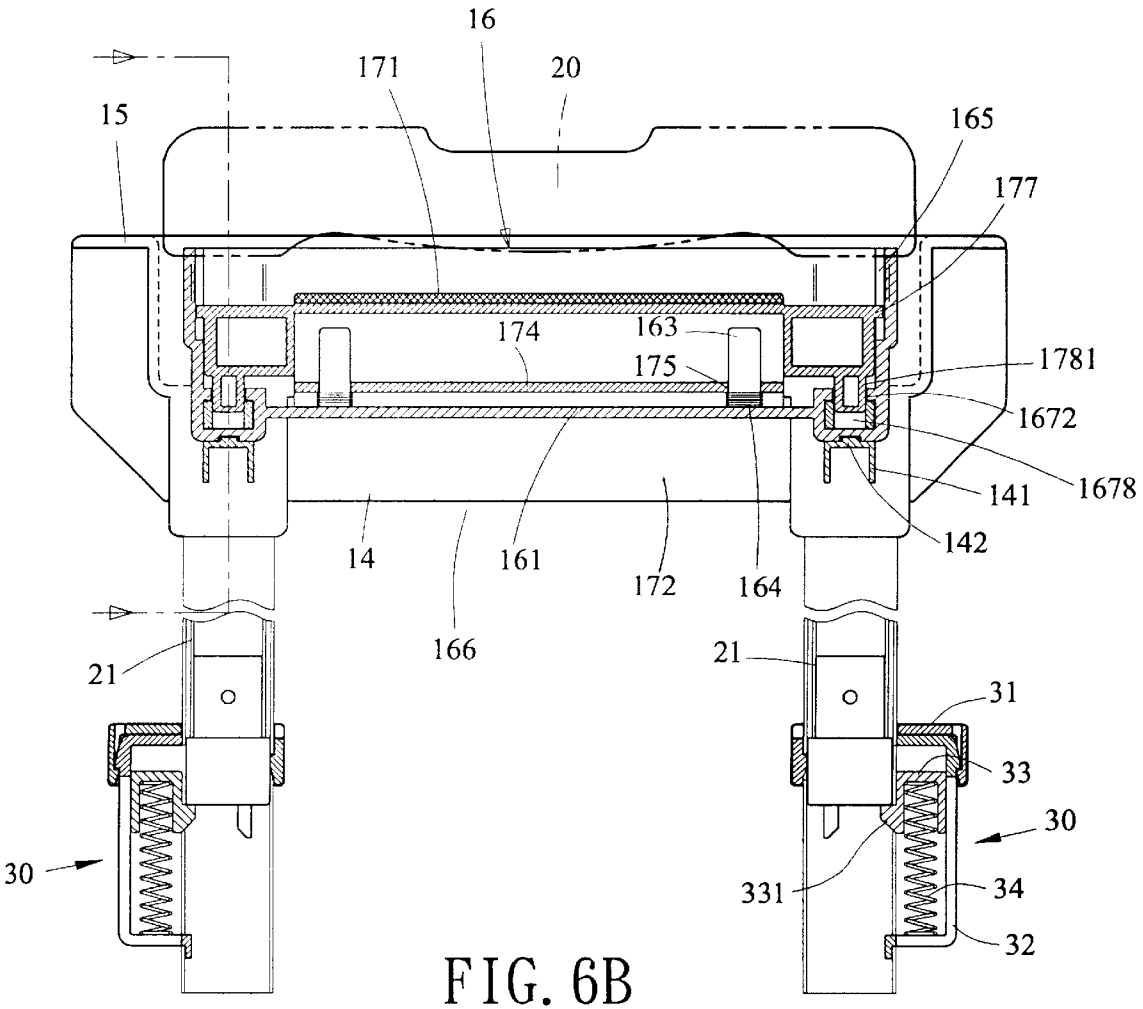
FIG. 6B is another cross-sectional view of the safety device showing the operation of the partially pulled handle shown in FIG. 6A.

In a fully retracted position of handle 21, the bottom of each sliding tube of handle 21 is engaged with catch 331 of sliding block 33 (see FIGS. 4 and 5). Also, stud 1679 of locking device 167 is elastically biased to move into hole 210 at the upper portion of sliding tube of handle 21, thus preventing handle 21 from further moving (see FIG. 5A). Once F-shaped mechanism 17 moves down to its maximum limit as shown in FIGS. 6A and 6B, slanted surface 1782 of wedge 178 is engaged with recessed slanted surface 1678 of locking block 1677, thus slanted surface 1782 is retracted inward.

Figure 2:
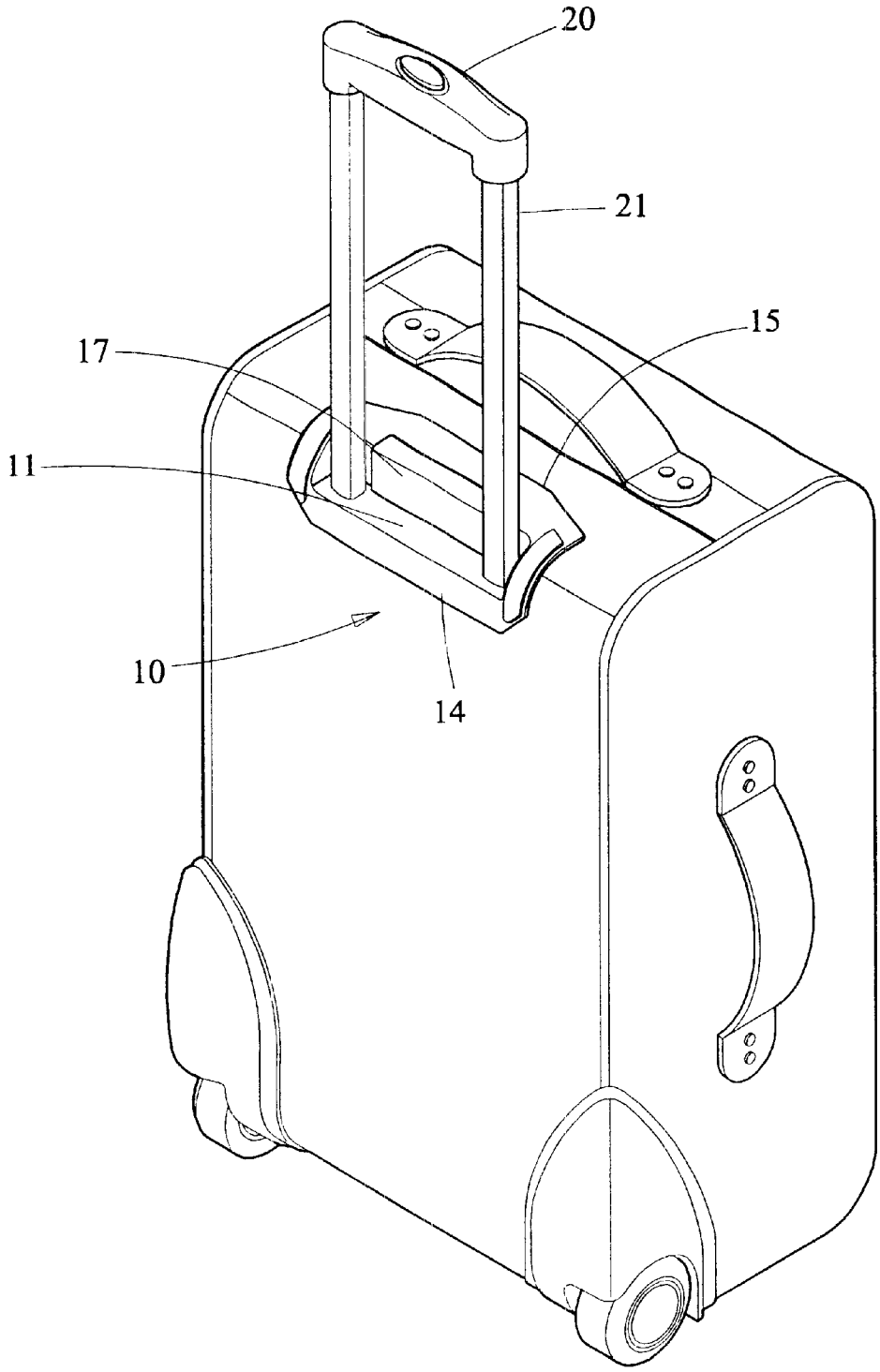
FIG. 2 is a perspective view of a luggage with retractable handle incorporating a safety mechanism for bezel according to the invention.
Figure 3:
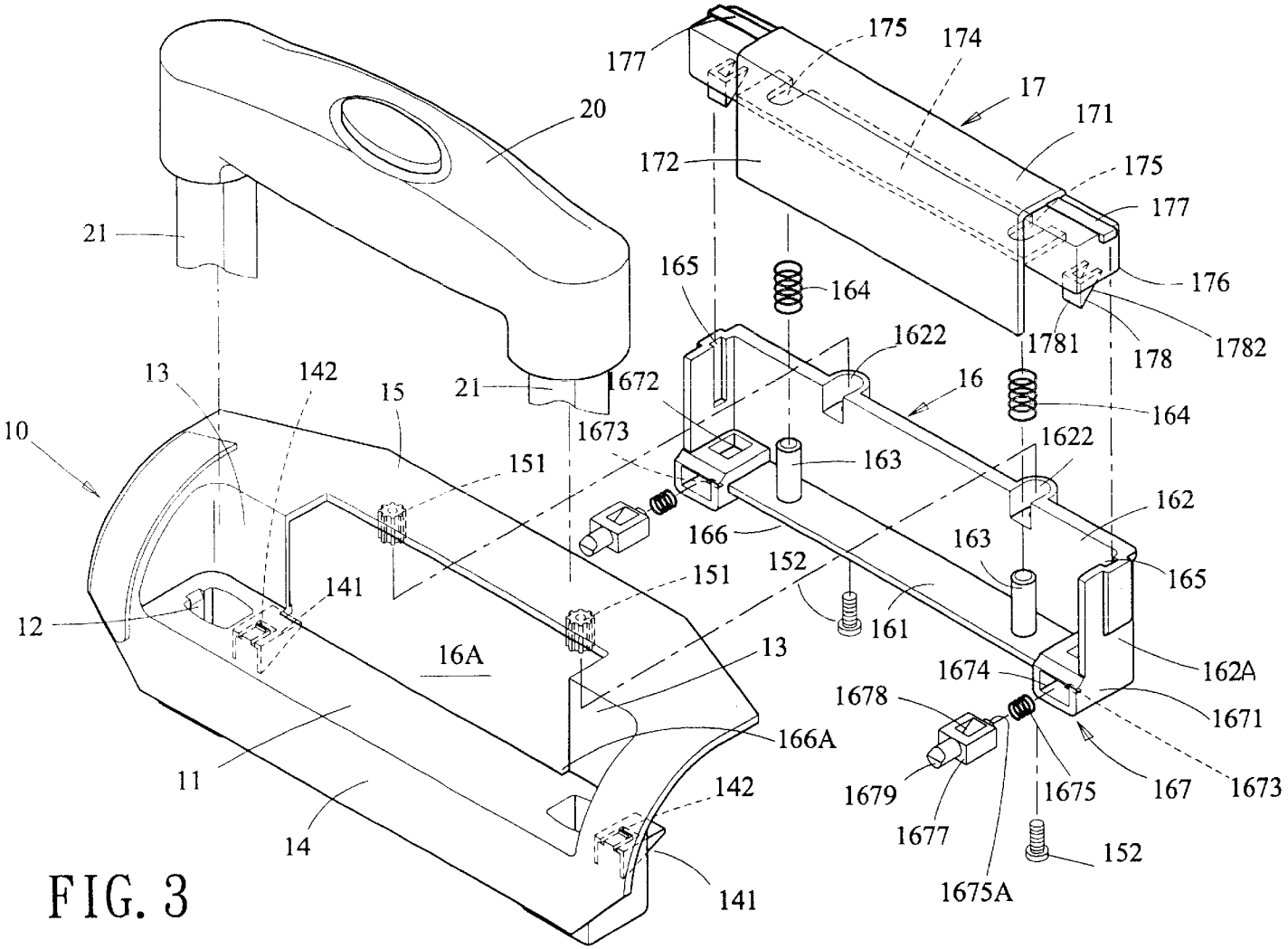
FIG. 3 is an exploded view of the safety device and a portion of associated bezel and handle.

In the pulling operation of handle 21, bouncing device 30 is activated to push the sliding tube of handle 21 upward to cause handle grip 20 to bounce a small while sufficient distance above the top plate 15 of bezel 10 such that user may put fingers into the gap formed between handle grip 20 and bezel 10 for pulling handle 21 upward to its maximum height thereafter so as to tow luggage along a supporting ground as best illustrated in FIG. 2.

In the retracting operation of handle 21, simply press down handle grip 20. As fingers of user touch top plate 15 of bezel 10, as stated above F-shaped mechanism 17 being soft and guided by a mechanism consisting of posts 163, springs 164, recessed portions 175, recesses 165, guide 166, gap 166A, and flanges 177, F-shaped mechanism 17 is moved down to retract into bezel 10. This can prevent user from being hurt while retracting the handle 21. Hole 210 of the fully retracted sliding tube of handle 21 is again engaged with stud 1679 of locking device 167. As a result, F-shaped mechanism 17 is automatically returned to a position being flush with top plate 15 of bezel 10 when hand is off the handle 21 as shown in FIGS. 5A and 5B.

While the invention herein disclosed has been described by means of specific embodiments, numerous modifications and variations could be made thereto by those skilled in the art without departing from the scope and spirit of the invention set forth in the claims.

What is claimed is:

1. A safety mechanism of luggage with a retractable handle assembly including a handle grip, a pair of sliding tubes having an upper hole, and a bezel having a concave member having a tunnel on either side for permitting each sliding tube to slide therein, a vertical plate, a seat plate, and a top plate, the safety mechanism comprising:

an elongate transverse groove between the vertical plate and the top plate of the bezel;

an elongate recessed engagement mechanism abutted on the sides, the bottom, and the rear of the transverse groove, the engagement mechanism including a bottom portion, a vertical portion, two spaced posts on the bottom portion, two first spring put on the posts, a guide in a front of the posts, and an elongate vertical recess at two sides of the vertical portion of the engagement mechanism;

an F-shaped mechanism being vertically movable in the engagement mechanism; wherein in a fully retracted position of the handle grip, the first springs are urged against and to push the F-shaped mechanism upward to engage with an underside of the top plate of the bezel;

a locking device at two sides of the engagement mechanism including a socket at two sides of the bottom portion of the engagement mechanism, the socket including a bottom opening, a top opening, and a front opening;

the F-shaped mechanism including an upper horizontal portion, a vertical portion, an extension horizontally extending from both sides thereof, a flange on the top of the extension, a central divider below the horizontal portion, a recessed portion at two sides of the central divider such that the posts are capable of passing through recessed portions when the F-shaped mechanism is moving vertically, and the bottom of the vertical portion of the F-shaped mechanism is capable of moving into a guide through the transverse groove;

two spaced tube members with notched circumferential surface at the underside of the top plate of the bezel;

two spaced slots at the vertical portion of the engagement mechanism such that the engagement mechanism is capable of being secured to the top plate of the bezel by driving fasteners through the tube members and the spaced slots;

a flexible latched member in two undersides of the seat plate of the bezel being clung to the bottom opening of the socket such that the F-shaped mechanism is capable of moving vertically with the flanges on the top of the extension being slidably received in the recesses of the engagement mechanism;

a wedge at the underside of two extension of the F-shaped mechanism, the wedge including a front planar portion and a rear slanted surface;

a locking block in the socket, the locking block including a recessed slanted surface on an upper surface, a rear peg, a spring loaded on the rear peg, and a front stud; and a bouncing device at the lower part of each sliding tube, the bouncing device including an upper frame member, a lower abutment member held by the upper frame member, a sliding block having a catch within the lower abutment member, and a second spring anchored in the lower abutment member, whereby pull the handle grip to activate the bouncing device to push each sliding tube upward to cause the handle grip to bounce a predetermined distance above the top plate of the bezel; and press down the handle grip to cause the F-shaped mechanism to move down simultaneously thus forming a space in the bezel by the downward moved F-shaped mechanism.

2. The safety mechanism of claim 1, wherein each of the upper horizontal portion and the vertical portion of the F-shaped mechanism is formed of soft material and the extension of the F-shaped mechanism is formed of hard material.

3. The safety mechanism of claim 1, wherein the extension of the F-shaped mechanism is formed integrally with the F-shaped mechanism.

4. The safety mechanism of claim 1, wherein the width of the upper horizontal portion of the F-shaped mechanism is about the same as that of the transverse groove and the bottom portion of the engagement mechanism, and the length of the vertical portion of the F-shaped mechanism is larger than the height of the vertical portion of the engagement mechanism.

5. The safety mechanism of claim 1, wherein the slanted surface of the wedge is disengaged from the top opening in an unlocked position of the handle.

6. The safety mechanism of claim 1, wherein the slanted surface of the wedge is engaged with the recessed slanted surface of the locking block in a locked position of the handle.

7. The safety mechanism of claim 1, wherein the top of the horizontal portion of the F-shaped mechanism is flush with the top plate of the bezel.

* * * * *